US005535773A

United States Patent [19]

Deller

[11] Patent Number: 5,535,773

[45] Date of Patent: Jul. 16, 1996

[54] HYDROMECHANICAL DIFFERENTIATING APPARATUS

[75] Inventor: Robert W. Deller, Saugus, Calif.

[73] Assignee: HR Textron Inc., Valencia, Calif.

[21] Appl. No.: 315,003

[22] Filed: Sep. 28, 1994

[51] Int. Cl.[6] ..... F15B 13/04

[52] U.S. Cl. ..... 137/106; 91/420; 91/421

[58] Field of Search ..... 91/420, 421; 137/106

[56] References Cited

U.S. PATENT DOCUMENTS

| | | | |
|---|---|---|---|
| 2,931,389 | 4/1960 | Moog et al. | 91/433 X |
| 3,042,005 | 7/1962 | Gray . | |
| 3,055,383 | 9/1962 | Paine | 91/421 X |
| 3,064,627 | 11/1962 | Blanton . | |
| 3,070,124 | 12/1962 | Fitzpatrick . | |
| 3,095,906 | 7/1963 | Kolm | 91/421 X |
| 3,138,072 | 6/1964 | Gray . | |
| 3,706,322 | 12/1972 | Carlson . | |
| 3,729,026 | 4/1973 | Wilke . | |
| 5,156,177 | 10/1992 | Bishoff . | |
| 5,240,041 | 8/1993 | Garnjost | 137/625.62 |

FOREIGN PATENT DOCUMENTS 114303 6/1945 Sweden .

*Primary Examiner*—Gerald A. Michalsky
*Attorney, Agent, or Firm*—Robbins, Berliner & Carson

[57] ABSTRACT

A hydromechanical differentiating system for actuator dynamic stiffness enhancement and dynamic load damping. A free floating spool valve receives a pressure signal and moves in opposite directions away from a null position. When the valve moves in response to an increase in the pressure signal it compresses fluid in a chamber connected at the opposite end of the cylinder in which the spool moves and simultaneously connects a source of fluid under pressure to the chamber causing the valve to return to its null position. Conversely, if the pressure signal decreases, the spool valve allows the fluid in the chamber to expand moving the valve away from the chamber and simultaneously connecting system return to the chamber to decrease the fluid pressure in the chamber and cause the valve to return to its null position.

3 Claims, 3 Drawing Sheets

HYDROMECHANICAL DIFFERENTIATING APPARATUS

FIELD OF THE INVENTION

The invention relates generally to hydraulic devices and more particularly to a hydromechanical differentiating apparatus which may be used inter alia for actuator dynamic stiffness enhancement and dynamic load damping.

BACKGROUND OF THE INVENTION

The use of several mechanisms for controlling hydraulic actuators which are in turn used to position control surfaces on aerospace vehicles is well known in the art. In some instances the loads which are to be controlled are extremely heavy or have large forces applied thereto. Under certain conditions such loads have a resonant frequency which is within or very near the band pass of the hydraulic actuating systems. Means must therefore be taken to damp oscillations that may occur as a result of application of hydraulic power from a control valve within the system to the load or as a result of external forces applied to the load. This becomes particularly acute when the frequency of application of the power is near or approaches the resonant frequency of the load. In other instances the dynamic stiffness of the actuator must be adjusted to minimize the risk of surface flutter; usually requiring an actuator stiffness increase.

In the prior art, systems exist to achieve dynamic load damping of flight control actuators. However, such mechanisms typically require two moving spools both of which are spring centered and to make the apparatus function properly there must also be included properly adjusted metering orifices. Although apparatus of the type disclosed in the prior art have proven successful for the purposes intended it has been found that due to the complexity of the systems they are difficult to construct, adjust and maintain. Typical of such prior art systems are those shown and described in U.S. Pat. Nos. 3,138,072; 3,042,005; and 3,064,627.

SUMMARY OF THE INVENTION

A hydromechanical differentiating apparatus which includes means for providing a chamber containing a compressible fluid as well as means for providing a pressure signal. A free floating valve means is disposed to receive the pressure signal and to move in first and second directions away from a null position responsive thereto. As the valve means so moves it connects either a source of fluid under pressure or a return for said source to the chamber which contains the compressible fluid. When the valve means moves in response to an increase in the pressure signal it compresses the fluid in the chamber at the opposite end of the valve and simultaneously connects the source of fluid under pressure to the chamber to increase the fluid pressure in the chamber and to return the valve to its null position. Conversely, when the pressure signal decreases, the valve means allows the fluid in the chamber to expand, moving the valve away from the chamber and simultaneously connecting return to the chamber to decrease the fluid pressure in the chamber and to cause the valve to return to its null position.

The invention also includes a system having a control valve for applying fluid under pressure to an actuator which in turn is connected to a load. A hydromechanical differentiating apparatus as above described is connected in one embodiment to enhance the stiffness of the actuator by applying pressure or return from a source of fluid under pressure to the actuator responsive to an increase or decrease of the pressure appearing on one side of the actuator. Alternatively, the structure as above described may be interconnected with the actuator to provide dynamic load damping through application of either pressure or return to the actuator.

A major feature of the present invention is that the hydromechanical differentiating apparatus utilizes a valve means to provide what is essentially the first differential of a pressure input signal which does not rely upon spring centering or critically adjusted flow orifices.

DETAILED DESCRIPTION OF THE DRAWINGS

The present invention provides a simple hydromechanical differentiator which effectively provides a first derivative pressure feed back signal which may be utilized within an actuator positioning system for the purpose of stiffness enhancement or dynamic load damping. The first derivative pressure signal is generated through the utilization of a spool valve which is hydromechanically locked at a null position. Upon the application of a pressure signal to the spool valve, the valve moves in an amount proportional to the pressure input signal and the volume and fluid bulk modulus of a compressible fluid contained within a chamber and which fluid is in contact with the spool. As the spool moves compressing the fluid a source of fluid under pressure is also applied to the volume to cause the spool to return to its null position. Upon such movement a pressure output signal is also generated which may be applied to an actuator positioning system for the purposes above described.

Figure 1:
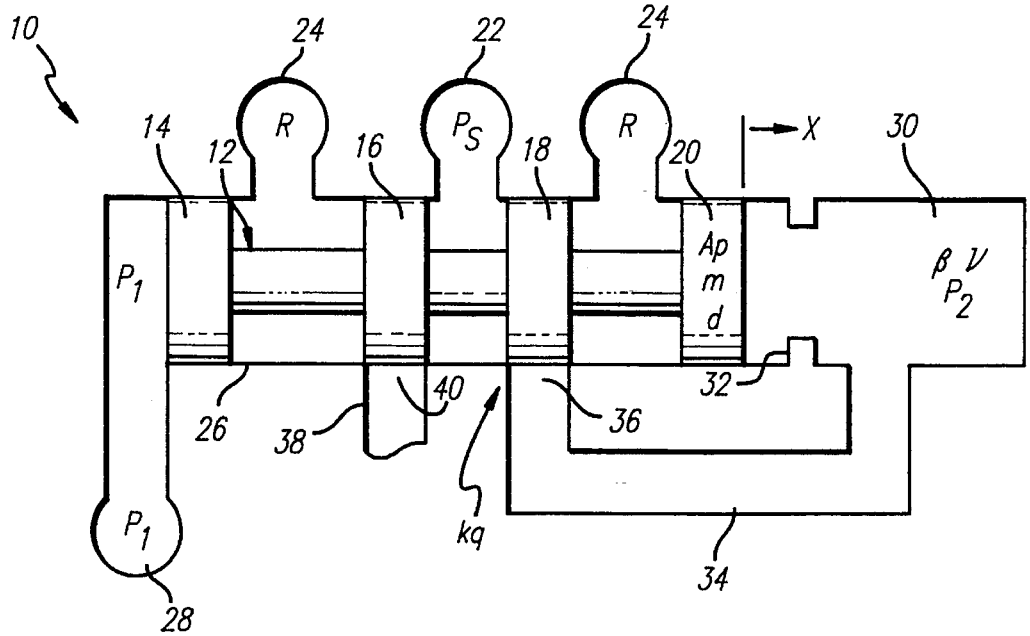
FIG. 1 is a schematic diagram of a hydromechanical differentiating apparatus constructed in accordance with the principles of the present invention.

A hydromechanical differentiator 10 built in accordance with the present invention is schematically illustrated in FIG. 1. As is therein shown, a spool valve 12 having lands 14, 16, 18 and 20 is disposed within cylinder 26 so as to be reciprocally operable therein without the aid of springs or similar mechanical devices. A source of fluid under pressure 22($P_S$) is connected to the cylinder 26 so as to apply the fluid under pressure within the cylinder between the lands 16 and 18. A return pressure for the source 22 as is illustrated at 24(R) is connected to the cylinder 26 so as to be disposed between the lands 14 and 16 and also between the lands 18 and 20.

Connected at one end of the cylinder 26 is a pressure signal source 28($P_1$). The pressure signal from the source 28 is applied to the end of the land 14 of the spool valve 12. At the opposite end of the cylinder 26 there is provided a chamber 30 which contains a compressible fluid such as hydraulic fluid. The chamber 30 and the fluid contained therein is in contact with the end of the land 20. A stop means 32 is utilized to prevent an overrun in movement to the right, as viewed in FIG. 1, of the spool valve 12.

Passageway means 34 is connected between a port 36 and the chamber 30. An additional passageway means 38 is connected to a port 40 also defined in the cylinder 26.

The land 18 on the spool valve 12 controls the opening and closing of the port 36 to thereby permit the application of fluid under pressure or return through the passageway means 34 to the chamber 30. At the same time upon movement of the spool valve 12 the land 16 opens the port 40 to provide either fluid pressure from the source 22 or return 24 to be applied to the output passageway means 38 for utilization by an apparatus to which the hydromechanical differentiator may be connected as will be more fully described herein below.

Again by way of initial explanation, the spool valve 12 is effectively hydromechanically locked in the position shown in FIG. 1 by the feed back caused by the metering port 36 connecting source 22 or return 24 to the chamber 30 and thus to the end of the land 20. Any spool valve 12 motion to the right as viewed in FIG. 1 will connect source 22 to the chamber 30 resulting in pressure build up which attempts to drive the spool valve 12 back to its null or closed position. Similarly, spool valve 12 motion to the left as viewed in FIG. 1 will vent the chamber 30 to return through the port 36 allowing the input pressure signal from the source 28 to drive the spool valve 12 back to its closed or null position. Thus, the spool valve 12 is hydromechanically forced to maintain a substantially steady state position at null thereby effectively washing out any steady state or bias pressure signal inputs. At the same time as the spool valve 12 reciprocates to the right or left as viewed in FIG. 1, responsive to initial application of a signal from source 28 there will appear at the output passageway 38 a pressure return or pressure source signal which is effectively in the form of the first derivative of the step function, steady state pressure from the source or return.

When the spool valve 12 is moved to the right in response to an increase in the input pressure signal 28 the fluid in the chamber 30 is compressed. The exact displacement of the spool valve 12 depends on the volume of fluid in the chamber 30, the area of the end of the land 20 and the fluid bulk modulus of the compressible fluid contained within the chamber 30. Such spool displacement opens the metering orifice between the land 18 and the left side of the port 36 as viewed in FIG. 1, thereby allowing fluid from the source 22 to flow therethrough into the chamber 30. Such flow integrates the spool valve 12 back toward the null position as shown in FIG. 1 at a diminishing rate as the metering orifice between the land 18 and the left side of the port 36 as viewed in FIG. 1 closes. The motion is exponential thereby approximating a differentiator in series with a pole as is shown in the derivations set forth in the appendix at the end of the specification. The gain (ratio of displacement to dP/dt) for a fixed spool area is determined by the volume in the chamber 30 and the fluid bulk modulus of the fluid contained therein. While the pole is independently set only by the valve flow gain which is set by the slot width of port 36.

Figure 2:
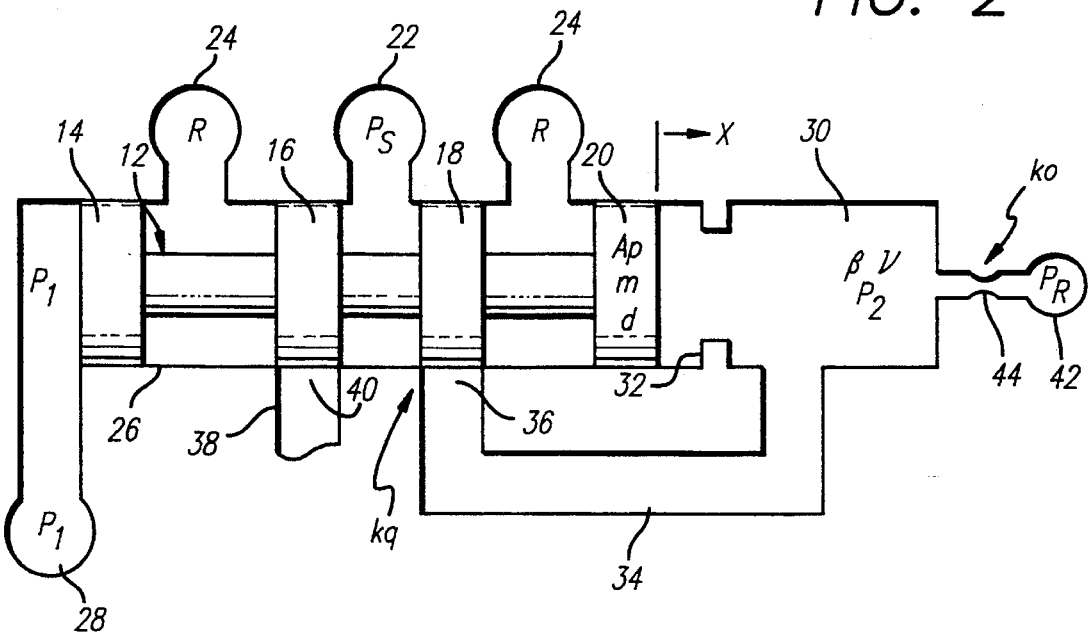
FIG. 2 is a schematic diagram of an apparatus of the type shown in FIG. 1 but which provides an adjustable lead lag network.

Referring now more specifically to FIG. 2 there is illustrated an embodiment of the hydromechanical differentiator constructed in accordance with the present invention wherein the spool is positioned in proportion to the input pressure signal as filtered by an adjustable lead lag network. As is therein shown the structure of the hydromechanical differentiator is identical to that shown in FIG. 1 as demonstrated by the utilization of the same reference numerals for the same components. The only change is the addition of a source of fluid reference pressure 42($P_R$) connected to the chamber 30 through a restriction orifice 44. Typically, if the apparatus as shown in FIGS. 1 and 2 is connected to an actuator having a pair of cylinder ports, then the reference pressure signal 42 will be the opposite cylinder port from that providing the input signal 28($P_1$). The structure as shown in FIG. 2 operates in much the same manner as that above described with respect to FIG. 1 except that the leakage path to the reference pressure source 42 allows a steady state displacement of the spool valve 12 for a fixed differential pressure between the input pressure signal from the source 28 and the reference pressure from the source 42. This mathematically results in an adjustable zero over a pole which is the lead lag characteristic.

As will be clearly understood by those skilled in the art, if the input pressure signal 28 decreases the spool valve 12 will be allowed to move to the left as viewed in FIG. 1. Such movement will cause the land 18 to move to the left and will connect the return 24 through the passageway means 34 and the right edge of the port 36 to the chamber 30. This will cause the pressure in the chamber 30 to decrease until such a time as the input pressure signal from the source 28 exceeds the pressure in the chamber 30 thereby driving the spool valve 12 back to its closed or null position. In the configuration as shown in FIG. 2 the zero frequency is set by the orifice area, the bulk modulus of the fluid within the chamber 30 and the volume of the fluid within the chamber 30. The pole frequency is independently set by the valve flow gain and the area of the end of the land 20 on the spool valve 12. As will be appreciated by those skilled in the art, the spool valve 12 will not return to the its null or closed position while an increased input pressure signal from the source 28 is applied to the land 14 as long as that signal is in excess of the reference pressure signal from the source 42. As a result, there will be some leakage flow through the metering orifice between the left side of the land 18 and the left side of port 36. This provides the lead lag characteristic to the circuit.

Figure 3:
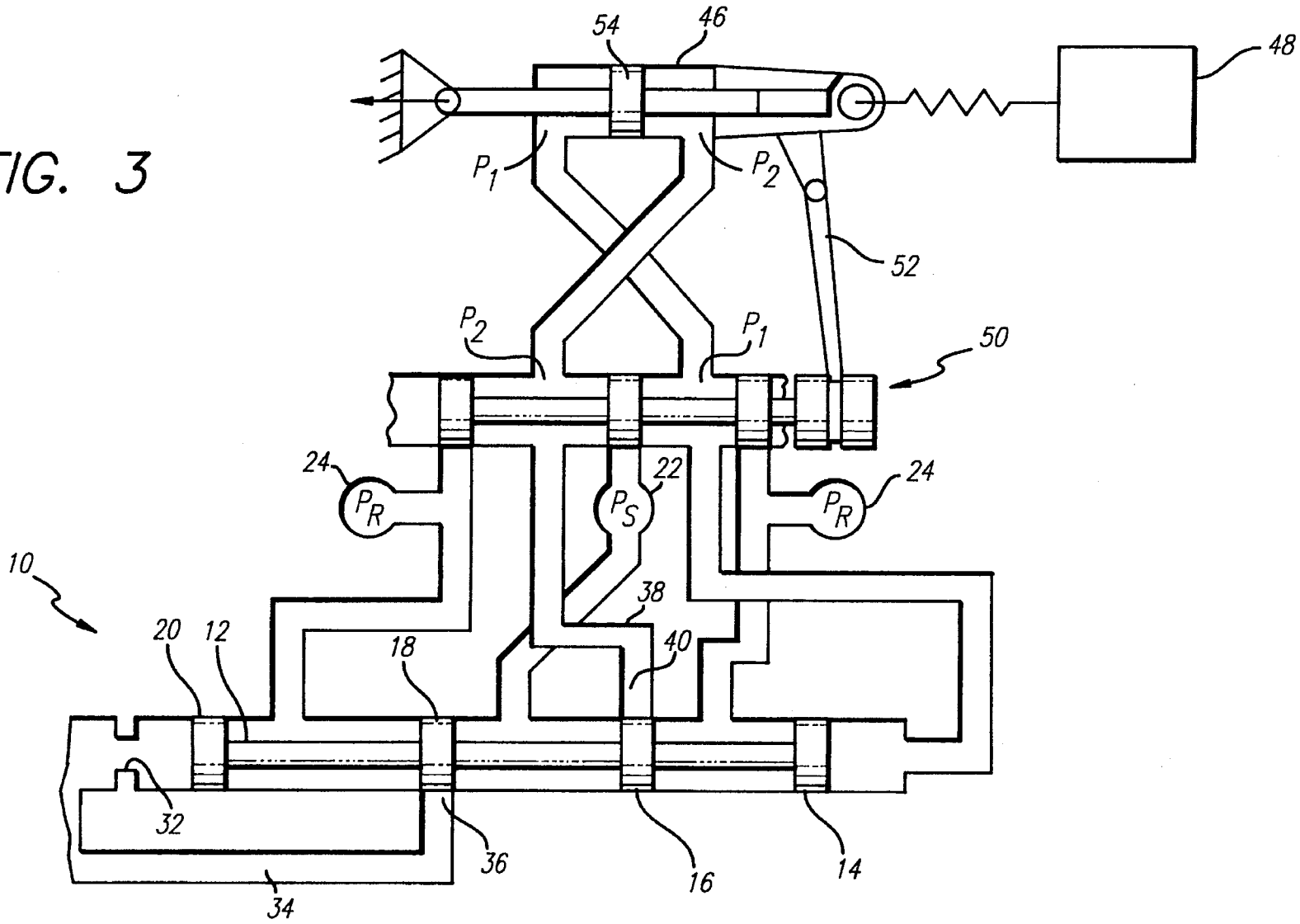
FIG. 3 is a schematic diagram of a system utilizing the apparatus as illustrated in FIG. 1 for enhancement of stiffness of the actuator.

Referring now more specifically to FIG. 3 there is shown the hydromechanical differentiator as illustrated in FIG. 1 and above described interconnected with an actuation system utilized to position a load such as a flight control surface of an aerospace vehicle. Again, the various parts of the hydromechanical differentiator as illustrated in FIG. 1 are designated by the same reference numerals in FIG. 3.

As is shown in FIG. 3 an actuator 46 is connected to a load 48 such as an aerospace vehicle control surface. It should be understood by those skilled in the art that the particular application illustrated is by way of example only and that any one of a number of various structures may have the apparatus of the present invention applied thereto. A control valve 50 is interconnected with an input device such as a pilot's input lever 52. The control valve reciprocates to connect the source of fluid under pressure 22($P_S$) or its return 24 to either side of the piston 54 in the actuator 46 to either extend or retract the actuator. As will readily be seen, the input pressure signal ($P_1$) is the pressure which appears in the retract chamber of the actuator 46 on the left of the piston 54. Thus, if the pressure $P_1$ increases, the spool valve 12 moves toward the left as viewed in FIG. 3, thereby applying pressure from the source 22 through the passageway means 34 to the chamber 30 thereby returning the spool valve 12 to its closed or null position as shown in FIG. 3. At the same time, when the spool valve 12 moves toward the left, return 24 is connected to the extend chamber of the actuator 46 to thereby enhance the differential pressure across the piston 54 thereby enhancing the stiffness of the actuator system as shown in FIG. 3.

Figure 4:
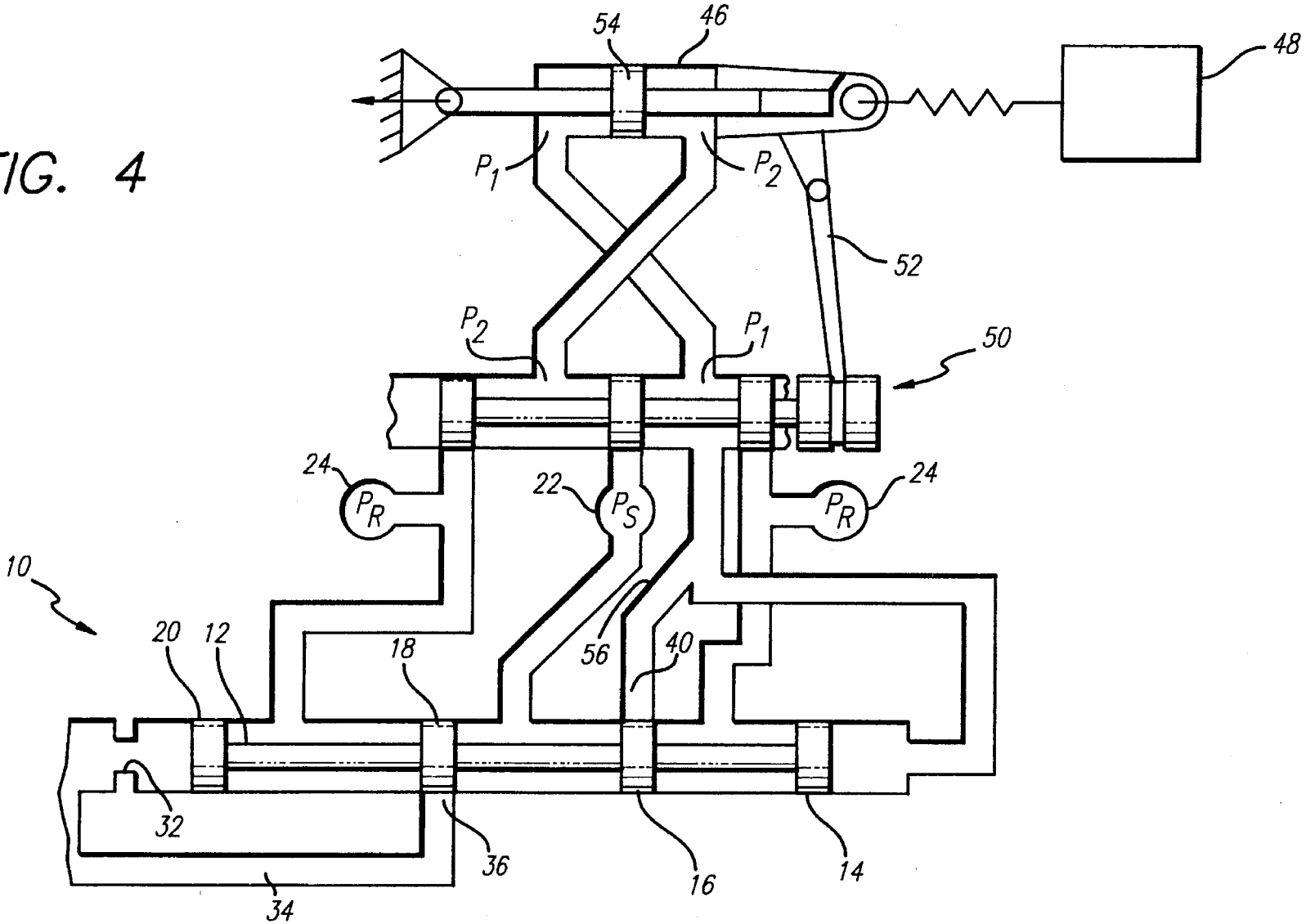
FIG. 4 is a schematic diagram of a system similar to that shown in FIG. 3, but connected to provide dynamic load damping.

Referring now more particularly to FIG. 4, the structure as illustrated in FIG. 1 is interconnected to an actuator system to provide dynamic load damping. All portions of the structure as shown in FIG. 4 are the same as those shown in FIG. 3 with the exception of the interconnection of the output signal which appears at the passageway means 38 of the hydromechanical differentiator. As is shown in FIG. 4 an additional passageway means 56 is utilized to interconnect the output passageway means 38 with the retract chamber to the left of the piston 54. As a result, those skilled in the art will appreciate that when the input pressure signal $P_1$ increases, the spool valve 12 will move toward the left with the resultant as above described, but in addition, the land 16 will move to the left thereby connecting system return to the retract chamber thereby immediately relieving the pressure build up therein.

There has thus been described a hydromechanical differentiator which provides a momentary signal which then decays exponentially as above described. This signal may then be used for actuator stiffness enhancement or dynamic load damping depending upon the particular application desired.

APPENDIX

The terms used in the following equations are defined as follows:

| | | |
|---|---|---|
| $A_p$ | = | Spool Area [in$^2$] |
| m | = | Spool mass [lb f − Sec$^2$/in] |
| d | = | Spool damping [lb f − Sec/in] |
| β | = | Fluid Bulk Modulus [lb f/in$^2$] |
| V | = | Chamber Volume [in$^3$] |
| $k_q$ | = | Metering Edge Flow Gain [in$^4$/sec] |
| $k_o$ | = | Orifice Flow Gain [in$^5$/sec/lb f] |
| $P_1$ | = | Chamber Pressures [lb f/in$^2$] |
| X | = | Spool Displacement [in] |
| S | = | Differential operator d/dt |

The dynamic equations for differentiation with a single pole are (no leakage from volume):

Solution including spool dynamics:

$$\frac{X(S)}{P_1(S)} = \frac{S}{\frac{m}{A_p}\left(S^3 + \frac{d}{m}S^2 + \frac{A_p^2\beta}{mV}S + \frac{A_p k_q \beta}{mV}\right)}$$

Neglecting Spool Dynamics:

m=0, d=0

$$\frac{X(S)}{P_i(S)} = \frac{S}{A_p\left(\frac{\beta}{V}S + \frac{k_q}{A_p}\right)}$$

Neglecting Spool Dynamics the Time Domain Solutions are:

$$RampResponse{:}X(t) = \frac{V}{k_q\beta}\frac{dP_1}{dt},$$

$$StepResponse{:}X(t) = \Delta P\frac{v}{A_p\beta}e^{-\left(\frac{k_q t}{A_p}\right)}$$

The dynamic equations for the lead-lag configuration are:

Full Dynamic Solution:

$$\frac{X(S)}{P_1(S)} = \frac{\left(S + \frac{k_o\beta}{V}\right)}{\frac{m}{A_p}\left[S^3 + \left(\frac{k_o\beta}{V} + \frac{d}{m}\right)S^2 + \left(\frac{dk_o\beta}{mV} + \frac{A_p^2\beta}{mV}\right)S + \frac{A_p k_q\beta}{mV}\right]}$$

Neglecting Spool Dynamics:

m=Ø, d=Ø

$$\frac{X(S)}{P_1(S)} = \frac{\left(S + \frac{k_o\beta}{V}\right)}{\frac{A_p\beta}{V}\left(S + \frac{k_q}{A_p}\right)}$$

What is claimed is:

1. A hydromechanical differentiating apparatus comprising:

(a) a cylinder having first and second end chambers and defining first, second, third and fourth ports;

(b) a free floating valve having a plurality of lands thereon disposed for reciprocation in said cylinder and being hydromechanically locked in null position in the absence of an input pressure signal;

(c) said first end chamber of said cylinder defining a predetermined volume containing a compressible fluid;

(d) means on said second end chamber of said cylinder for receiving an input pressure signal for application to said valve;

(e) a source of fluid under pressure and a return therefor connected to said first and second ports;

(f) first passageway means for connecting said first end chamber of said cylinder to said third port;

(g) second passageway means connected to said fourth port for providing an output signal;

(h) one of said lands on said valve connecting one of said source pressure and said return to said first end chamber of said cylinder through said first passageway means when said valve moves in a first direction and the other of said pressure and return thereto when said valve moves in the other direction;

(i) said valve momentarily moving from its null position responsive to application of said input pressure signal thereto and immediately returning to said null position upon application of said source pressure and return to said first end chamber of said cylinder thereby to provide an output pressure signal at said fourth port which is proportional to the first derivative of the applied input pressure signal.

2. A hydromechanical differentiating apparatus as defined in claim 1 wherein said first chamber is a closed chamber except for said passageway means.

3. A hydromechanical differentiating apparatus as defined in claim 1 wherein said free floating valve includes a spool valve having a plurality of lands, including first and second end lands, disposed for reciprocal movement within a cylinder; said first end land receiving said pressure signal and said second end land communicating with said chamber and said compressible fluid therein.

* * * * *